US007410239B2

(12) United States Patent
Takahashi et al.

(10) Patent No.: US 7,410,239 B2
(45) Date of Patent: Aug. 12, 2008

(54) PRINTING APPARATUS

(75) Inventors: Kiichiro Takahashi, Kawasaki (JP); Naoji Otsuka, Yokohama (JP); Osamu Iwasaki, Tokyo (JP); Minoru Teshigawara, Yokohama (JP); Tetsuya Edamura, Kawasaki (JP); Yoshinori Nakagawa, Kawasaki (JP); Satoshi Seki, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 11/350,877

(22) Filed: Feb. 10, 2006

(65) Prior Publication Data

US 2006/0187247 A1 Aug. 24, 2006

(30) Foreign Application Priority Data

Feb. 21, 2005 (JP) ..... 2005-044244

(51) Int. Cl.
*B41J 2/21* (2006.01)

(52) U.S. Cl. ..... 347/43

(58) Field of Classification Search ..... 347/43
See application file for complete search history.

(56) References Cited

U.S. PATENT DOCUMENTS

| | | | | |
|---|---|---|---|---|
| 4,593,295 | A | 6/1986 | Matsufuji et al. | |
| 6,474,766 | B1 * | 11/2002 | Cooper | 347/15 |
| 6,712,443 | B2 | 3/2004 | Kanda et al. | |
| 6,846,066 | B2 | 1/2005 | Teshikawara et al. | |
| 6,877,833 | B2 | 4/2005 | Teshigawara et al. | |
| 6,896,356 | B1 | 5/2005 | Otsuka et al. | |
| 6,899,413 | B2 | 5/2005 | Otsuka et al. | |
| 6,976,748 | B2 | 12/2005 | Yabe et al. | |
| 2002/0070999 | A1 | 6/2002 | Teshigawara et al. | |
| 2004/0207685 | A1 | 10/2004 | Otsuki | |
| 2005/0057600 | A1 | 3/2005 | Teshigawara et al. | |
| 2005/0122355 | A1 | 6/2005 | Kanda et al. | |
| 2007/0139510 | A1 | 6/2007 | Hamasaki et al. | |

FOREIGN PATENT DOCUMENTS

| | | |
|---|---|---|
| CN | 1453130 | 11/2003 |
| EP | 1 088 669 | 4/2001 |
| EP | 1 356 940 | 10/2003 |
| JP | 2001-96770 | 4/2001 |
| JP | 2001-96771 | 4/2001 |
| JP | 2003-116014 | 4/2003 |

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

For a serial color ink jet printing apparatus that forms an image using a symmetric printing head that ejects large dots and small dots, the configuration of a printing head is provided for suppressing, to the extent possible, a cyclic fluctuation in the main scanning direction. According to the present invention, individual nozzle arrays are arranged so that two nozzle arrays, i.e., a cyan nozzle array c1 and a magenta nozzle array m1, that are located nearer each other, form dots on adjacent scan lines. With this arrangement, a high quality image, having neither an uneven density nor an uneven color, can be formed when a printing head is inclined, or when a cyclic shift in printing positions occurs, depending on the position of the main scanning direction.

6 Claims, 13 Drawing Sheets

PRINTING APPARATUS

BACKGROUND OF THE INVENTION

1. Field of the Invention

The present invention relates to a printing apparatus, and particularly to the configuration of a printing head that uses a set consisting of a plurality of printing element arrays (nozzle arrays), which correspond to color agents to be ejected, to form an image.

2. Description of the Related Art

At present, personal computers, word processors and facsimile machines are employed widely in offices and at home, and for such systems, printing apparatuses employing a variety of printing systems have been provided for the output of information as printed matter. Of all these printing apparatuses, however, those that employ ink jet systems provide more advantages, e.g., comparatively, they are easily compatible with colorization, they produce less noise during operation, they print high-quality images on various types of printing medium, and they are compactly made. Ink jet printing apparatuses are further classified, in accordance with differences in their printing operations, into serial types and full-line types. And for personal use, of these two types, there is widespread acceptance of serial type ink jet printing apparatuses, compact devices that are available at low cost.

As the use of such serial type ink jet printing apparatuses has spread, there has been an increasing demand for printing apparatuses that can output higher quality images at higher speeds. In response to this demand, various techniques have been developed.

For example, a printing apparatus has already been provided that employs light cyan and light magenta, which have lower agent concentration, in addition to the basic four colors of cyan, magenta, yellow and black, in order to suppress the granularity of a highlighted portion and to obtain high gradation. Furthermore, a method and an apparatus have also already been disclosed whereby orange, red, green or blue ink, which has a different hue than has the basic four colors, is loaded for use in printing. Generally, image quality can be improved by using many types of ink, or by appropriately adjusting the components of the ink. In addition, ink such as dye ink and pigment ink, for which the hues are the same but properties such as permeability and diffusion differ, may also be selectively employed.

One well known example set of inks that is employed is made up of the following six ink types, i.e., black dye ink, yellow dye ink, magenta and light magenta dye ink, and cyan and light cyan dye ink. This set of inks is especially appropriate when a high quality photographic image, obtained using a digital camera or a scanner, is to be output to a glossy printing medium. Another example set of inks is made up of the following four ink types, i.e., black pigment ink, yellow dye ink, magenta dye ink and cyan dye ink. This set is especially effective when a black image, such as a black character or a table for which sharpness is important, is to be printed on plain paper.

Another factor that influences image quality is the size of the dot formed on a printing medium. For example, in a highlighted portion, small dots are better suited for forming in order to suppress granularity of the printed portion, while in high density portions, large dots are better suited for forming in order to obtain an appropriate optical density. Thus, a printing head and a printing method have previously been disclosed that enable the printing of two sizes of dots, i.e., large and small dots. When individual pixels can be expressed at densities having multiple levels, high image gradation can be obtained.

When a plurality of types of ink are provided for individual pixels, to obtain a high quality image, ink dots are preferably not overlapped. Especially for cyan and magenta, their luminosity would be decreased due to dots overlapping each other. A technique has already been disclosed whereby these dots are formed so that, to the extent possible, they are separated in the same pixel. This technique is hereinafter referred to as a CM separation technique. Details of the CM separation technique have already been disclosed, for example, in Japanese Patent Application Laid-open No. 2003-116014.

When the above described technique has been realized for a serial type ink jet printing apparatus, various problems unique to the serial type have occurred. For example, for a color ink jet printing apparatus wherein cyan, magenta and yellow ink nozzles are arranged in parallel in the scanning direction of a printing head, an imaging problem called color banding has occurred due to the order in which ink is provided to a printing medium. In the case of a printing head for the above described arrangement, the order in which colored inks are provided to the printing medium is reversed between the forward path and the return path for scanning. That is, for example along the forward path, colored ink is provided to the printing medium in the order cyan, magenta and yellow, and along the return path, colored ink is provided in the order yellow, magenta and cyan. This difference in the printing order produces, more or less, a difference of hue on a printing medium. Therefore, as one result of the printing of an image having a uniform tone, the image areas printed along the forward path and the image areas printed along the return path are alternately arranged with different colors, which are developed, and there is considerable deterioration in the image quality.

To completely prevent this color banding problem, an image need merely be formed by scanning only along the forward path or only along the return path. However, compared with bi-directional scanning, the printing period required for such unidirectional scanning is greatly extended. Thus, to resolve this problem, a method has been disclosed whereby two nozzle arrays for the individual colors are symmetrically arranged on the printing head, on either side in the scanning direction, so that color banding is prevented and bidirectional scanning is performed (see, for example, Japanese Patent Application Laid-open No. 2001-96770 and No. 2001-96771).

In Japanese Patent Application Laid-open No. 2001-96770, a symmetrical printing head is disclosed wherein nozzle arrays are arranged in the order CMYYMC, for example, in the main scanning direction. According to the description given for this reference material, since ink of the same color is evenly ejected through two nozzle arrays during a single scanning, not only can color banding due to the printing order be prevented, but also discrepancies in ink ejection by the individual nozzles can be dispersed, so that, in appearance, they are not noticeable.

According to the invention disclosed in Japanese Patent Application Laid-open No. 2001-96771, nozzle arrays symmetrically arranged are employed evenly as in Japanese Patent Application Laid-open No. 2001-96770, and a plurality of dots of the same color are printed as a single pixel to provide multi-gradient printing. For this gradient printing, sorting of data for the right and left nozzle arrays is controlled in accordance with the gradation value to maintain equal frequencies for the use of the two nozzle arrays.

For an apparatus such as an ink jet printing apparatus that represents an image by arranging multiple dots, how to form dots on a printing medium in high accuracy of position is important in order to obtain a high quality image. However, in the above described serial type ink jet printing apparatus there are many weak points whereat mechanical errors tend to occur, e.g., accuracy errors tend to occur during the moving of a carriage whereon a printing head is mounted, during the mounting of the printing head on the carriage and during the conveying of a printing medium. So, the occurrence of such mechanical errors cannot be prevented completely. When they become excessive, they can be identified easily and adversely affect the appearance of an image. It is possible, however, to perform calculations that can improve either the configuration of a printing head or a printing method, and to cause effects that adversely affect an image to become less noticeable. That is, the next issue is how to handle various mechanical errors so, though they may affect the appearance of an image, they become less noticeable.

However, previously, satisfactory studies have not been performed to determine how the above described mechanical errors actually affect an image when a conventional configuration includes large and small ink discharge orifices or a symmetrical printing head, or when a new printing method, such as the CM separation technique, is employed. Furthermore,there has not been a satisfactory study performed to determine an appropriate printing head and an appropriate printing method for preventing such effects.

Through studies performed by the present inventors, it was confirmed that new image effects occurred when a symmetrical printing head was mounted so it was inclined relative to the scanning direction. Specifically, for a CMYYMC symmetrical printing head, we found that the shifting was the greatest for cyan dots located the furthest outward, and that between dots, the distance shifted differed, depending on the set of nozzle arrays employed. The difference in the shifting distance caused cyclical color unevenness, and this was identified as a distinctive image affect. Further, it was also confirmed that a state wherein multiple nozzle arrays were arranged in a printing head influenced the degree to which image deterioration occurred due to the above described mechanical errors. As a result of intense study, performed employing a serial ink jet printing apparatus that carries out CM separation using large and small dots, the present inventors found a new optimal orifice arrangement for a printing head and an optimal printing method.

SUMMARY OF THE INVENTION

The present invention can provide a configuration for a printing head for a serial type color ink jet printing apparatus that forms an image using a symmetrical printing head that ejects large dots and small dots, whereby cyclic color banding in the main scanning direction is prevented to the extent possible.

An aspect of the present invention is a printing apparatus using a printing head, which includes a plurality of printing element arrays, in each of which a plurality of printing elements discharging a color agent on a printing medium are arranged at a predetermined pitch in a predetermined direction, provided in accordance with color agent types and amounts of color agent to be discharged. The printing head is scanned in a direction differing from the predetermined direction to form an image on the printing medium. The printing head has, for each of at least two types of color agents, first and second printing element arrays for discharging the same color agent in the same amount, the first and second printing element arrays being shifted relative to each other by half the predetermined pitch in the predetermined direction, and third and fourth printing element arrays for discharging the same color agent in the same amount smaller than that of the first and second printing element arrays, the third and fourth printing element arrays being shifted relative to each other by half the predetermined pitch in the predetermined direction. The first and third printing element arrays are adjacent to each other in the scanning direction and shifted by an amount less than half the predetermined pitch in the predetermined direction. The first and second printing element arrays and third and fourth printing element arrays for each of the at least two types of color agents are arranged at positions such that color orders are symmetrical in the scanning direction, respectively, and the first printing element array for one of the at least two types of color agents is arranged so as to be closer to the first printing element array for the other of the at least two types of color agents than the second printing element array for the other type of color agent, and the first printing element away for the one of the at least two types of color agents, and the first printing element array for the other of the at least two types of color agents are arranged so as to be shifted relative to each other by half the predetermined pitch in the predetermined direction.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The embodiments of the present invention will now be described in detail while referring to the accompanying drawings.

Figure 1:
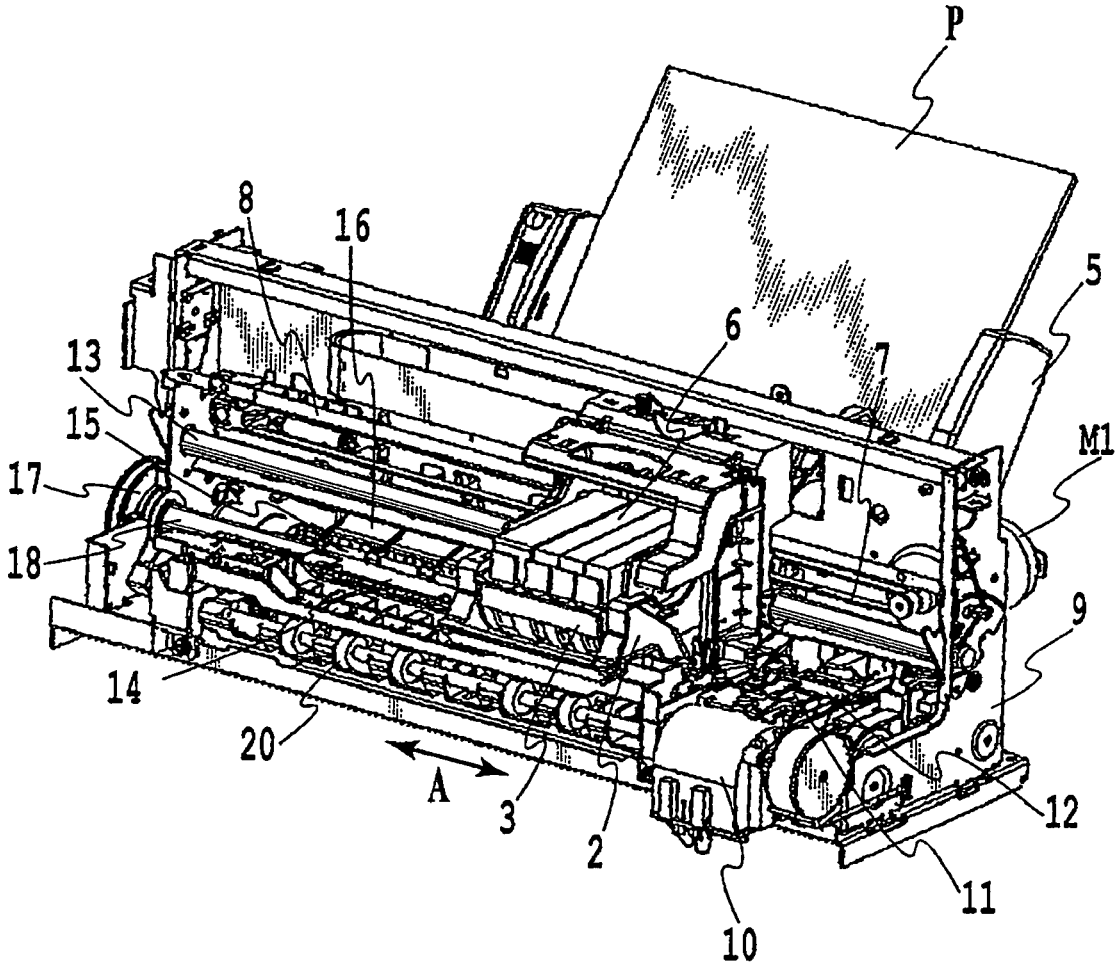
FIG. 1 is a perspective view of the internal configuration of an ink jet printing apparatus according to one embodiment of the present invention.

FIG. 1 is a perspective view of the internal configuration of an ink jet printing apparatus according to this embodiment.

In FIG. 1, a printing head 3 is mounted on a carriage 2 for scanning. The carriage 2 is connected to part of a drive belt 7 that constitutes a transmission mechanism for obtaining the driving force produced by a carriage motor M1, and is supported and guided by a guide shaft 13 so it is moved in a direction A. At this time, the carriage 2 can perform scanning in either the forward direction or the reverse direction by either the forward rotation or the reverse rotation of the carriage motor M1. A scale 8 is used to detect the location of the carriage 2. In this embodiment, a transparent PET film on which black bars are printed at predetermined pitches is employed as the scale 8, and one end of the scale 8 is fixed to a chassis 9 while the other end is supported by a leaf spring (not shown). When a sensor provided for the carriage 2 optically detects a bar printed on the scale 8, the current location of the carriage 2 can be obtained.

On the carriage 2, ink cartridges 6 are detachably mounted in consonance with the types of ink used by the ink jet printing apparatus. For simplification of the drawing, only four ink cartridges are shown for this embodiment; however, the configuration is not limited to this number. For example, five types of ink, i.e., first and second black ink, cyan, magenta and yellow ink may be employed, and five ink cartridges for individual ink types may be mounted. A detailed description for the ink will be given later.

When a print start instruction is received, a paper feeding mechanism 5 feeds a printing medium P to the printing position of the printing apparatus, i.e., the scanning position for the printing head 3. A platen 14 is located at the scanning position for the printing head 3, and supports, from below, the printing medium P at the location whereat printing is performed by the printing head 3.

The printing head 3 in this embodiment includes a black ink chip and a color ink chip. Formed in these chips are a plurality of nozzles (printing elements) and grooves for supplying ink, and ink supply paths are formed in the carriage 2, so that ink from the corresponding ink cartridges 6 can be supplied to the grooves. Further, the joint faces of the carriage 2 and the printing head 3 appropriately contact each other so as to enable required electrical connections.

For each nozzle of the printing head in this embodiment, a heater is provided at the distal end of the ink path where ink is filled. Upon receiving a voltage pulse consonant with a print signal, the heaters, which are electrothermal converters, exert thermal energy, and generate bubbles in the ink paths through film boiling. Then, by employing a change of pressure caused by the growth or the contraction of the bubbles, ink is ejected through discharge ports. The printing head 3 performs ink ejection in accordance with a print signal, while moving in the direction indicated by A.

The arrangement of a conveying system will now be briefly described. A convey roller 18 is driven by a convey motor (not shown). A pinch roller 15 uses a spring (not shown) to bring the printing medium P into contact with the convey roller 18. A pinch roller holder 16 rotatably supports the pinch roller 15. A convey roller gear 17 is attached at one end of the convey roller 18. The convey roller 18 is connected to the convey motor through the convey roller gear 17 and an intermediate gear (not shown), and is rotated by the convey motor. When one scanning by the printing head 3 has been completed, the convey roller 18 is rotated, and conveys the printing medium P a distance corresponding to the printing width of the printing head 3. When the scanning by the printing head 3 and the conveying of the printing sheet P are intermittently repeated, an image is gradually formed on the printing medium P.

Discharge rollers 20 are used to discharge the image bearing medium P outside the printing apparatus. As well as the convey roller 18, the discharge rollers 20 receive and are rotated by the driving force supplied by the convey motor.

A recovery device 10 for maintaining the ejection function of the printing head 3 is located at a predetermined position (e.g., a position corresponding to a home position) outside the range (the scanning area) within which the carriage 2 reciprocates during the printing operation. The recovery device 10 includes: a capping mechanism 11, for capping the discharge port face (the face whereat the discharge port arrays for individual colors are arranged) of the printing head 3; and a wiping mechanism 12, for cleaning the discharge port face of the printing head 3. In the recovery device, a suction mechanism (not shown), such as a suction pump, interacts with the capping of the discharge port face by the capping mechanism 11, so that ink can be forcibly discharged from the individual discharge ports. As a result, viscous ink and bubbles are removed from the ink paths of the printing head 3, and the ejection state of the printing head 3 is recovered. Furthermore, by capping the discharge port face of the printing head 3 during a non-printing period, the printing head 3 can be protected, and the drying of ink can be prevented. The wiping mechanism 12, located near the capping mechanism 11, performs cleaning by removing ink droplets attached to the discharge port face of the printing head 3. Through the above described operation of the recovery device 10, which includes the capping mechanism 11 and the wiping mechanism 12, maintenance of the printing head 3 is performed as needed to maintain the normal ejection state of the printing head 3.

Figure 2:
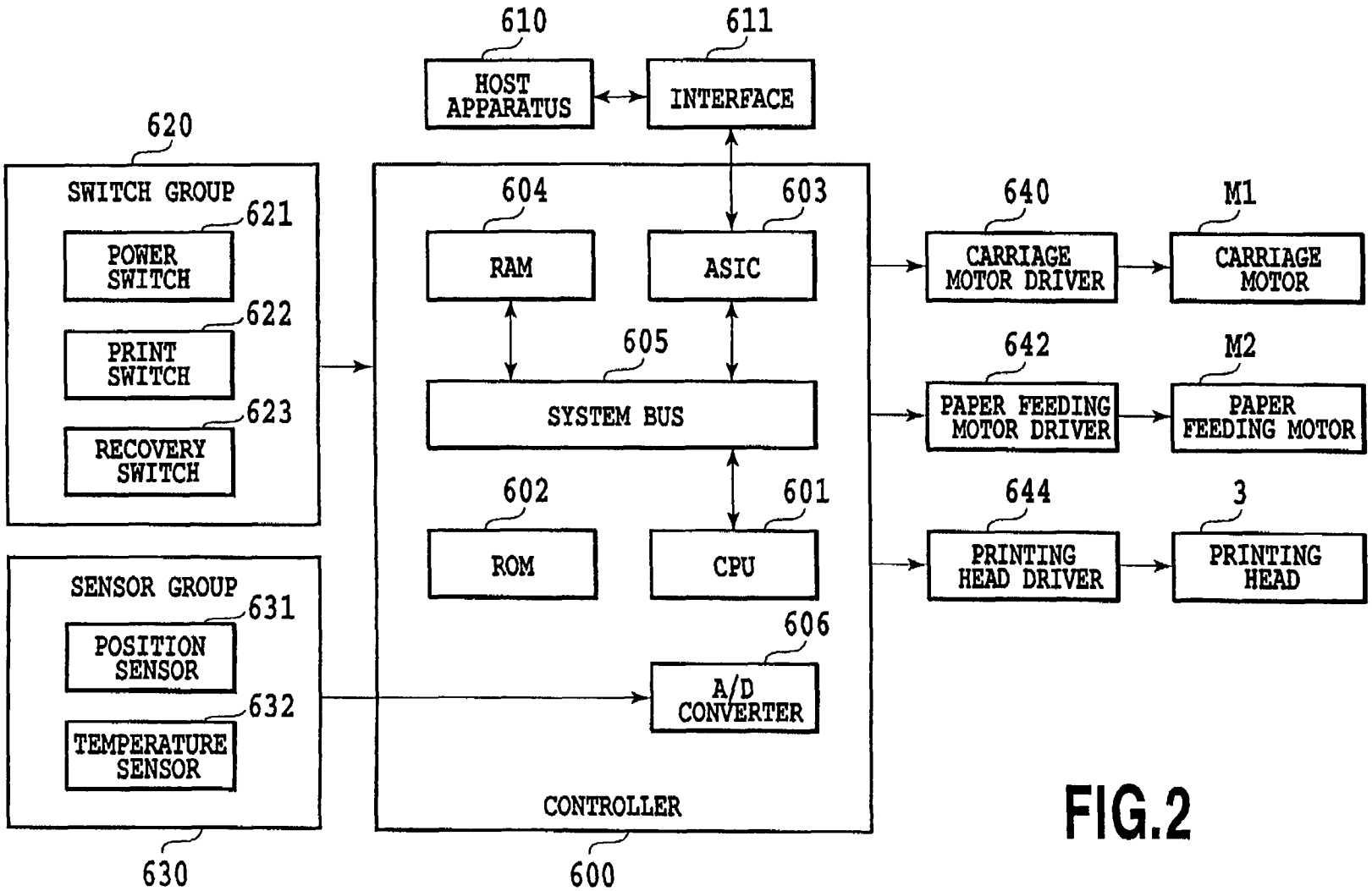
FIG. 2 is a block diagram showing the arrangement of the control system of the ink jet printing apparatus according to the embodiment of the present invention.

FIG. 2 is a block diagram showing the configuration of the control system of the ink jet printing apparatus according to this embodiment.

A controller 600 comprises: a CPU 601, which is a microcomputer, a ROM 602, an application specific integrated circuit (ASIC) 603, a RAM 604, a system bus 605 and an A/D converter 606. Programs for executing various printing modes described later, control programs for printing operations, a program for image process sequences described later, and data for a required table and other fixed data are stored in the ROM 602. The ASIC 603 generates control signals for controlling the carriage motor M1, for controlling a paper feeding motor, and for controlling the ejection of ink by the printing head 3, while the individual printing mode is performed. The RAM 604 is used as a storage area for developing image data, or for the temporary storage of work data. The system bus 605 interconnects the CPU 601, the ASIC 603 and the RAM 604 and permits these components to exchange data. The A/D converter 606 receives, from a sensor group 630, analog signals that it converts into digital signals and transmits to the CPU 601.

A host apparatus 610 is an image data supply source that is externally connected to the ink jet printing apparatus of this embodiment. The host apparatus 610 may be a host computer, an image reader or a digital camera. An interface (I/F) 611 is arranged between the host apparatus 610 and the controller 600 for the exchange of information, such as image data, commands and status signals.

A switch group 620 includes switches, used by an operator to enter instructions, such as a power switch 621, a switch 622 for instructing a printing start, and a recovery switch 623 for instructing the start of a recovery process for the printing head 3. The sensor group 630 includes: a position sensor 631, which either determines whether the printing head 3 is located at the home position or reads the bar of the scale 8 to detect the current position of the carriage 2; and a temperature sensor 632, which is arranged at an appropriate location within the printing apparatus to detect the environmental temperature.

A carriage motor driver 640 is used to drive the carriage motor M1, a paper feeding motor driver 642 is used to drive a paper feeding motor M2, and a printing head driver 644 is used to drive the individual heaters of the printing head 3. These drivers are controlled by the controller 600.

When image data are received from the host apparatus 610, the CPU 601 analyzes a command of print data transferred via the interface 611, and develops image data to be printed in the RAM 604.

At each scanning, the ASIC 603 directly accesses the storage area (print buffer) of the RAM 604, obtains drive data for the individual printing elements, and transmits the drive data to the printing head driver 644.

The ink types applicable for this embodiment will now be explained. In this embodiment, two types of black ink are prepared. The first black ink contains as a color material a carbon black pigment, and this ink is used in the monochrome printing mode, for example, for text documents. Surface processing using a carboxyl group, for example, is performed on the surface of the pigment, so that it is almost uniformly dispersed in the ink. Further, to prevent evaporation of the ink, it is preferable that black ink additionally contains a polyalcohol, such as glycerin, as humectants. When printing is performed using this first black ink, the pigment is fixed to the surface layer of the printing medium, and sharp and deep black characters or figures can be represented. Since text documents are frequently printed on plain paper, one of the important elements is that the edges of printed dots are not deteriorated. On the other hand, speedy permeation and fixing of ink to the printing medium is also important element. Thus, in order to improve the fixing of ink to plain paper within a range wherein the edges will not be deteriorated, an acetylene glycol surfactant may be added to the first black ink to adjust its permeability. In addition, a macromolecular polymer may be added as a binder to increase adhesion between the pigment and the printing medium.

The second black ink contains a black dye as a color material, and is used mainly in the color printing mode. Furthermore, in order for the ink to permeate the surface of the printing medium appropriately fast, an acetylene glycol surfactant is added at a critical micelle concentration or higher. For the second black ink, as well as for the first black ink, it is preferable that a polyalcohol, such as glycerin, be added as a humectant in order to prevent the evaporation of the ink. Further, to increase the solubility of the color agent, urea, for example, may also be added In this embodiment, dye ink, containing dyes for developing the colors cyan, magenta and yellow, is employed for the color printing of photographic images. When ink in these colors and the first black ink are employed at the same time, it becomes apparent that there are differences in the permeating speeds of the dye ink and the pigment ink, and these differences tend to adversely affect image reproduction and produce unwanted effects, such as bleeding and feathering, at boundaries between color inks and the black ink. Therefore, for the color printing of a comparatively high quality image, such as a photographic image, the second black ink, which is a dye ink, is more appropriate. At this time, it is preferable that humectants, a surfactant and an additive, such as are used for the second black ink, also be added to color ink. Further, it is preferable that the amount of surfactant to be added be adjusted so that the surface tensions of all these inks are substantially equal. This is true because when the permeability of all four ink types, relative to the printing medium, are uniform, blurring (bleeding) that occurs between printed areas on paper can be suppressed. Furthermore, it is preferable that other characteristics, such as viscosity, be adjusted equally among the four ink types.

The preferable set of ink used for printing an image has been explained. However, the present invention is not limited to this set of ink. The effects of the present invention are not reduced depending on the content of ink, and the present invention can actually be applied for a case wherein, for example, pigment ink and dye ink are employed together.

The arrangement of a printing head used for this embodiment will now be explained.

Figure 3:
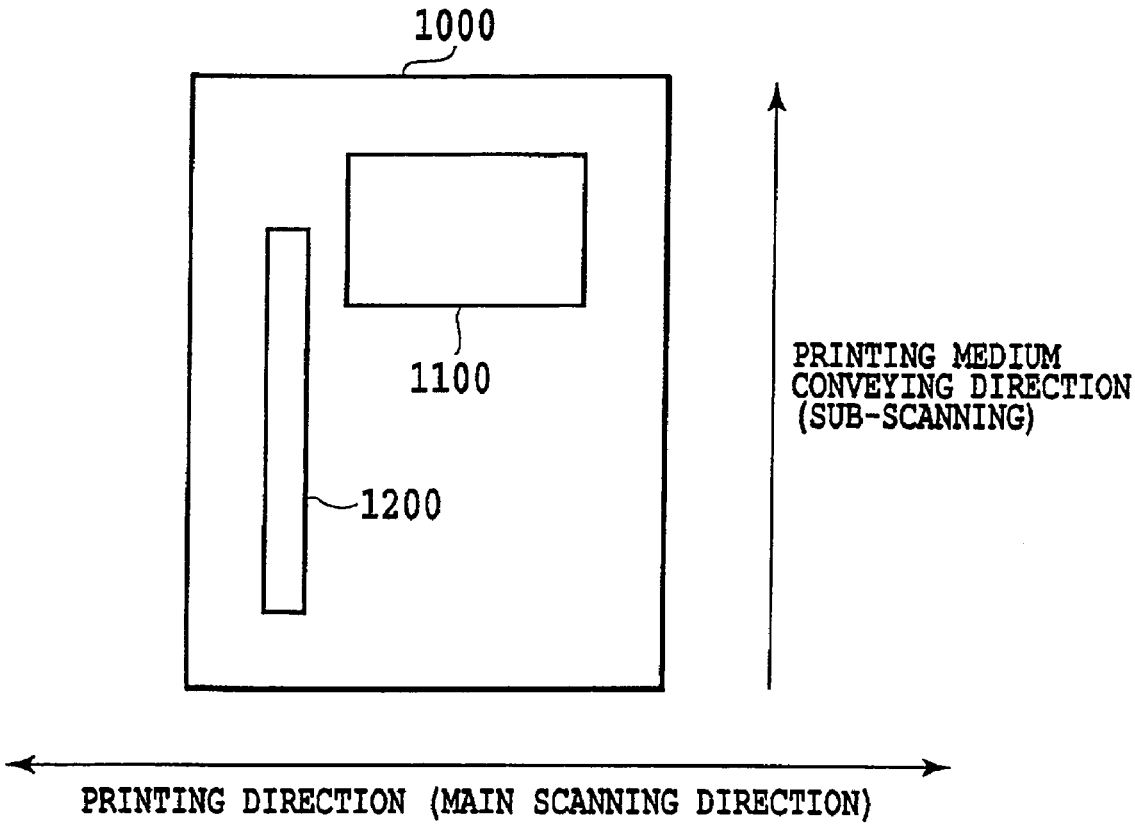
FIG. 3 is a diagram, viewed from the orifice face side, of a printing head applied for the embodiment of the present invention.

FIG. 3 is a diagram showing a printing head applicable for this embodiment, viewed from the discharge port side. In FIG. 3, a color chip 1100 and a black chip 1200 are formed on a base material 1000. Nozzles for ejecting the first black ink are arranged on the black chip 1200, which is wider than the color chip 1100 in the direction in which a printing medium is to be conveyed. When a black image is printed by the black chip 1200, the width of an image printed by one scanning of the printing head is larger than that printed by the color chip 1100. Thus, the number of scans required to print one page of a black image can be smaller than that required to print a color image, and a desired image can be output within a shorter period of time.

In addition, in this embodiment, the positions of the color chip 1100 and the black chip 1200 are slightly shifted relative to each other in the printing medium conveying direction. This is done to reduce, as to the extent possible, bleeding caused by providing pigment ink in an area where dye ink is printed, and with this arrangement, pigment ink is provided for a printing medium prior to dye ink.

The color chip 1100 will now be explained.

Figure 4:
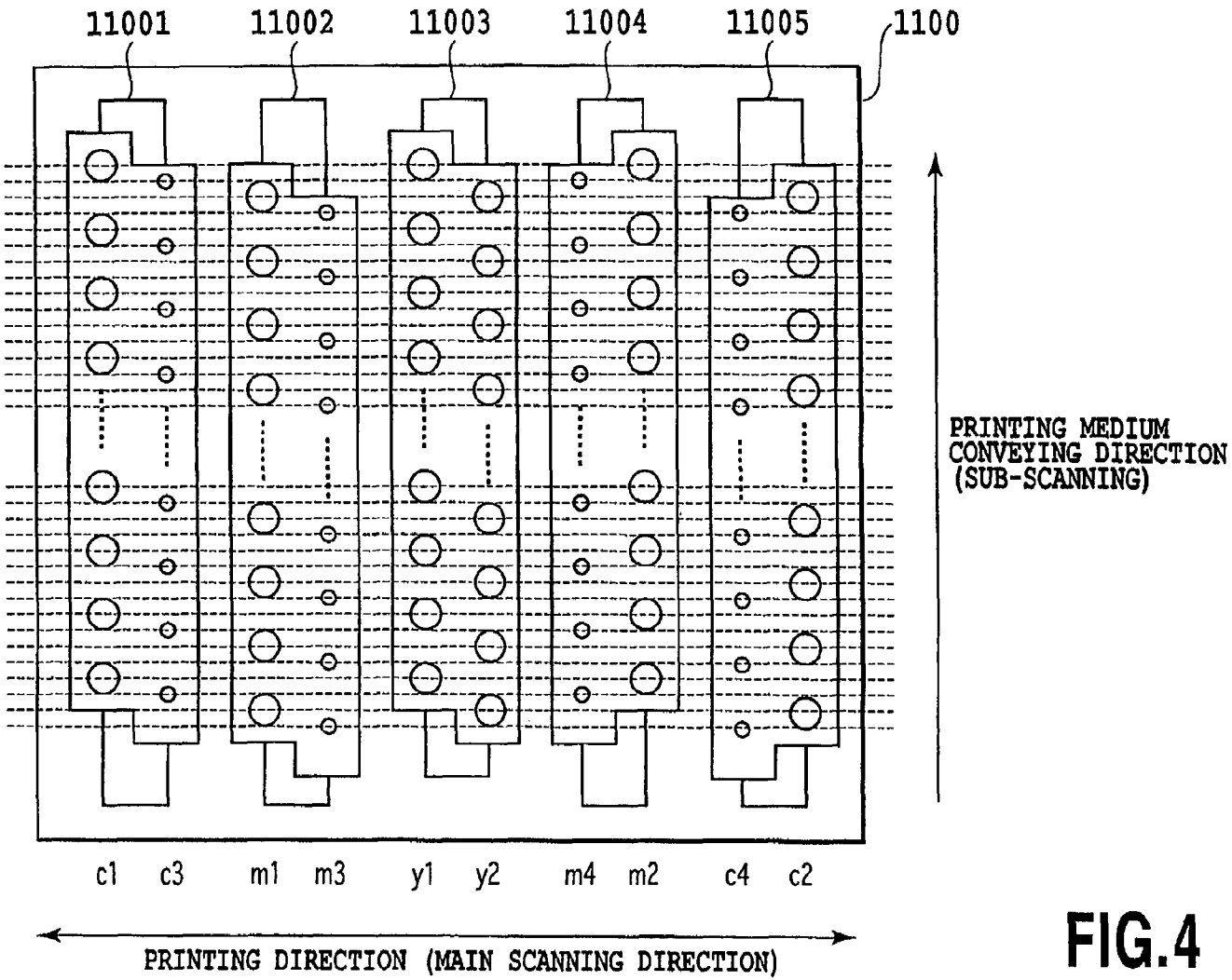
FIG. 4 is a schematic diagram showing the arrangement of orifice arrays on a color chip according to the embodiment of the present invention.

FIG. 4 is a schematic diagram showing the arrangement of discharge port arrays of the color chip 1100 for this embodiment. The color chip 1100 is made of silicon, and five grooves 11001 to 11005 are formed in parallel in the main scanning direction. A plurality of discharge ports, ink paths communicating with these ports, heaters formed along one part of the ink paths and supply paths communicating in common with a number of ink paths are formed in the individual grooves 11001 to 11005. The grooves 11001 and 11005 correspond to cyan ink, the grooves 11002 and 11004 correspond to magenta ink, and the groove 11003 corresponds to yellow ink. That is, as for the color orders in the scanning direction, grooves are arranged symmetrically, and in both forward scanning and reverse scanning, ink is provided for a printing medium in the order cyan, magenta, yellow, magenta and cyan.

Drive circuits (not shown) for driving the heaters are provided between the grooves of the color chip 1100. The heaters and the drive circuits can be produced through the same process as the film deposition for a semiconductor. Further, the ink paths and the discharge ports are made of a resin, and in the reverse face of the silicon chip 1100, ink supply paths for supplying ink are formed at the positions corresponding to the individual grooves.

In this embodiment, a nozzle array c1 for forming large dots and a nozzle array c3 for forming small dots are arranged in parallel in the groove 11001, a nozzle array m1 for forming large dots and a nozzle array m3 for forming small dots are formed in parallel in the groove 11002, nozzle arrays y1 and y2 for forming large dots are arranged in parallel in the groove 11003, a nozzle array m4 for forming small dots and a nozzle array m2 for forming large dots are arranged in parallel in the groove 11004, and a nozzle array c4 for forming small dots and a nozzle array c2 for forming large dots are arranged in parallel in the groove 11005. For the individual nozzle arrays, 64*n* (n is a counting number) discharge ports are arranged at a pitch of 600 dpi (dots per inch) in the direction in which a printing medium is conveyed. In addition, two nozzle arrays formed in the same groove are shifted at a ¼ pitch (2400 dpi) in the printing medium conveying direction. Furthermore, the nozzle arrays, such as the nozzle arrays c1 and c2, that print dots of the same color and the same size, are symmetrically located, being shifted a half pitch (1200 dpi). With this arrangement, an image can be formed at a resolution of 1200 dpi for large and small dots, though the nozzles are arranged at a density equivalent to 600 dpi in each nozzle array. That is, according to the printing head of this embodiment, image forming of 1200 dpi using large dots and small dots is enabled for cyan and magenta, and image forming of 1200 dpi using large dots is enabled for yellow.

As the feature of this embodiment, the cyan nozzle array and the magenta nozzle array, which are adjacent to each other, are shifted relative to each other at a half pitch in the direction in which a printing medium is conveyed. For each scanning, the printing elements (e.g., c1 and m2) in the grooves that are not adjacent form cyan and magenta dots on the same scanning line, and the printing elements (e.g., c1 and m1) in the adjacent grooves form dots on the scan line adjacent in the direction in which the printing medium is conveyed (sub-scanning direction). This process will be specifically described by means of a comparison made with a conventional common printing head.

Figure 5:
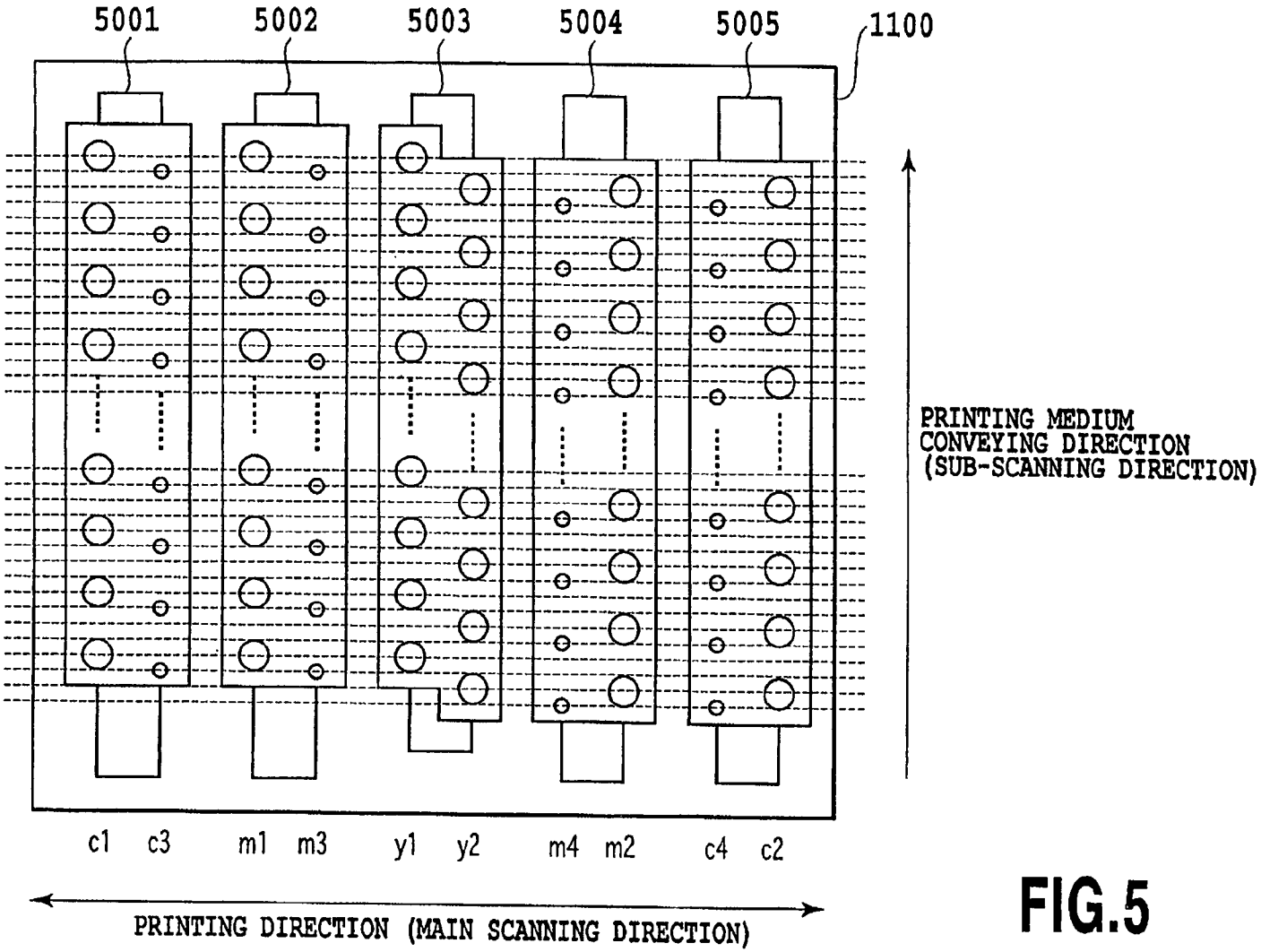
FIG. 5 is a schematic diagram showing a common conventional arrangement example for a printing head that can eject large dots and small dots.

FIG. 5 is a schematic diagram showing an example conventional arrangement for a printing head that can eject large dots and small dots. In this example, a nozzle array c1 and a nozzle array m1 are formed at the same position in the sub-scanning direction, as are nozzle arrays c2 and m2, and c3 and m3. That is, unlike the printing head shown in FIG. 4 for this embodiment, for each scanning, the nozzle arrays (e.g., c1 and m1) in the adjacent grooves form cyan and magenta dots on the same scanning line, and the nozzle arrays (e.g., c1 and m2) in the grooves at a distance form dots on a scanning line adjacent in the direction in which a printing medium is conveyed. Conventionally, this arrangement was convenient for the printing head manufacturing process. However, according to the review performed by the present inventors, it was confirmed that this printing head arrangement is not appropriate for the use of the CM separation technique that is effective for the recent image design.

The CM separation will be briefly described. As previously described, the CM separation is a technique whereby, in order to prevent the deterioration of colors expressed in a printed image, the printing positions of cyan dots and the printing positions of magenta dots are separated to prevent, to the extent possible, their overlapping. This CM separation can be efficiently performed together with the INDEX technique that has been employed especially recently.

Figure 6A:
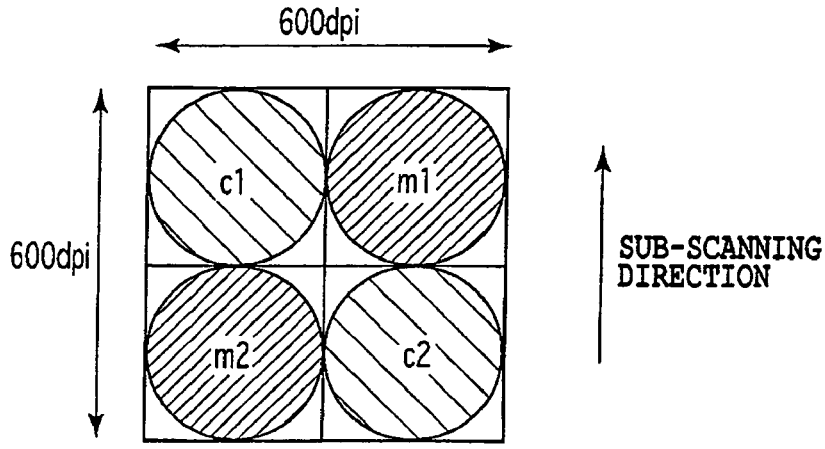
FIGS. 6A and 6B are schematic diagrams for explaining a method for employing the INDEX technique to perform CM separation.
Figure 6B:
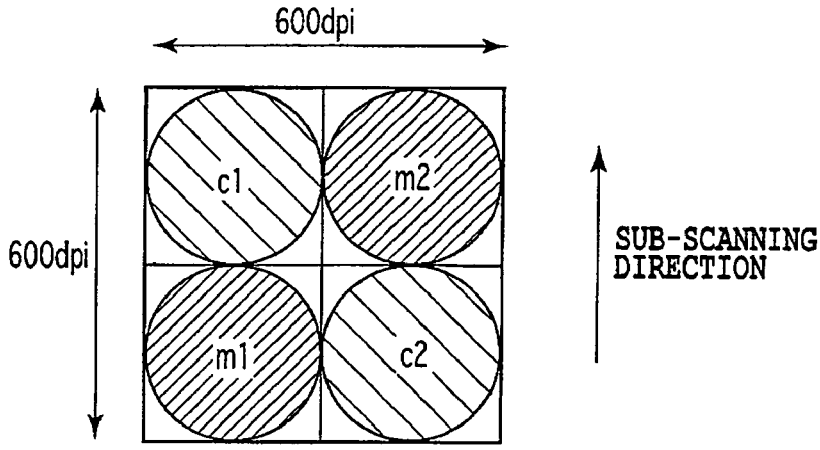

FIGS. 6A and 6B are schematic diagrams for explaining a method for performing the CM separation using the INDEX technique. The ink jet printing apparatus of this embodiment receives multiple tone image data at a resolution of 600 ppi×600 ppi, and in accordance with the level of the multiple tone data, performs printing at a resolution of 1200 dpi×1200 dpi. At this time, as shown in FIGS. 6A and 6B, since up to four dots can be printed in areas corresponding to one pixel of an input resolution, five gradations, from level 0 to level 4, can be expressed for a dot having a single color and diameter. In order to arrange dots in consonance with the individual level values, a 2×2 matrix pattern, for which the printing/non-printing of dots is predetermined, is referred to. This matrix pattern is generally called an INDEX pattern.

There is a case wherein an INDEX pattern is defined for each ink color. In addition, the INDEX pattern may be so defined that, to the extent possible, when the CM separation is to be performed the printing positions of cyan dots and the printing positions of magenta dots do not match. In FIGS. 6A and 6B, a signal at level 2 is input both for cyan and magenta. Two cyan dots and two magenta dots are arranged at diagonal positions, and the colors in the areas of one 600 dpi pixel are represented. It is felt that when the CM separation is to be performed by using the INDEX technique, in many cases, such a halftone dot arrangement will be obtained.

When this dot arrangement is provided by the printing head shown in FIG. 5, the nozzle arrays for printing the dots in the individual areas are as shown in FIG. 6A. A magenta dot printed by the nozzle array m2 is located immediately below a cyan dot printed by the nozzle array c1, and a cyan dot printed by the nozzle array c2 is located immediately below a magenta dot printed by the nozzle array m1. That is, cyan and magenta dots, continued in the sub-scanning direction, are formed by the nozzle arrays that are comparatively arranged at a distance.

When the printing head for this embodiment explained while referring to FIG. 4 is employed, the nozzle arrays used for printing dots in the individual areas are as shown in FIG. 6B. A magenta dot printed by the nozzle array m1 is located immediately below a cyan dot printed by the nozzle array c1, and a cyan dot printed by the nozzle array c2 is located immediately below a magenta dot printed by the nozzle array m2. That is, with the printing head for this embodiment, cyan and magenta dots continued in the sub-scanning direction are formed by the nozzle arrays in the grooves that are adjacent to each other.

An influence that such a difference in the printing condition has on an image will now be explained.

FIGS. 7A to 7D are diagrams showing the printing states when the above described halftone images of four pixels are continued in the sub-scanning direction. In the state shown in FIG. 7A, cyan dots and magenta dots are printed as the result of printing that ideally is performed when there is no error included in the ink-jet printing apparatus and the printing head. Cyan dots and magenta dots are provided by ideally performing the CM separation, and a uniform blue image is formed.

Figures 7A, 7B, 7C, 7D:
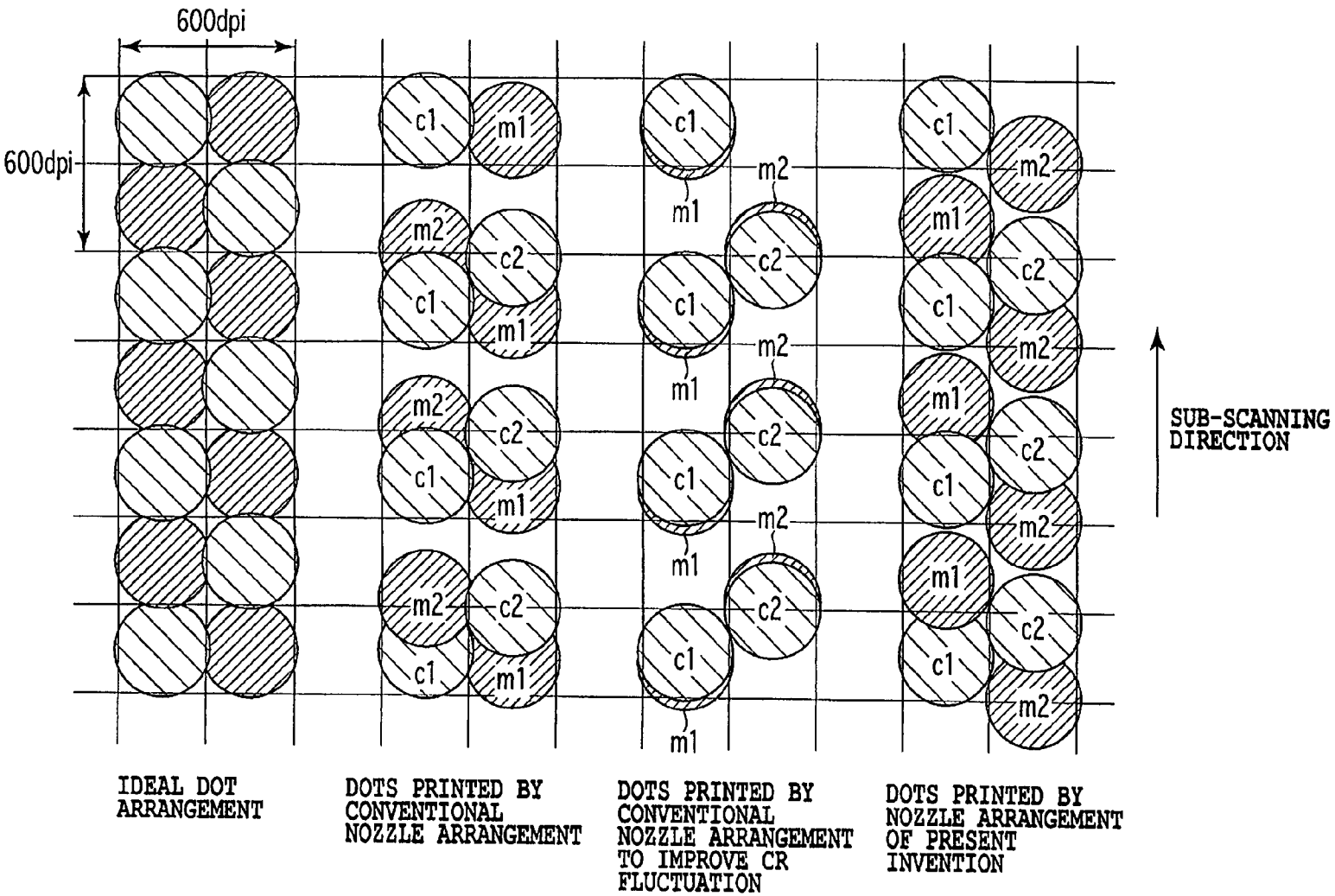
FIGS. 7A to 7D are diagrams showing printed states when halftone images of four pixels are contiguous in the sub-scanning direction.

In the state in FIG. 7B, dots are printed using the printing head shown in FIG. 5. In this case, the color chip 1100 of the printing head is mounted while being turned to the right about 0.1°. The position shift among the nozzle arrays is noticeable since the distances between the nozzle arrays in the main direction are large, and dots printed by the arrays c2 and m2 are shifted downward relative to dots printed by the arrays c1 and m1. Therefore, as shown in FIG. 7B, blank portions and portions wherein dots are overlapped unnecessarily alternately appear. In this embodiment, between the arrays c1 and c2, a position shift of about 11 μm is present in the sub-scanning direction.

Figure 8A:
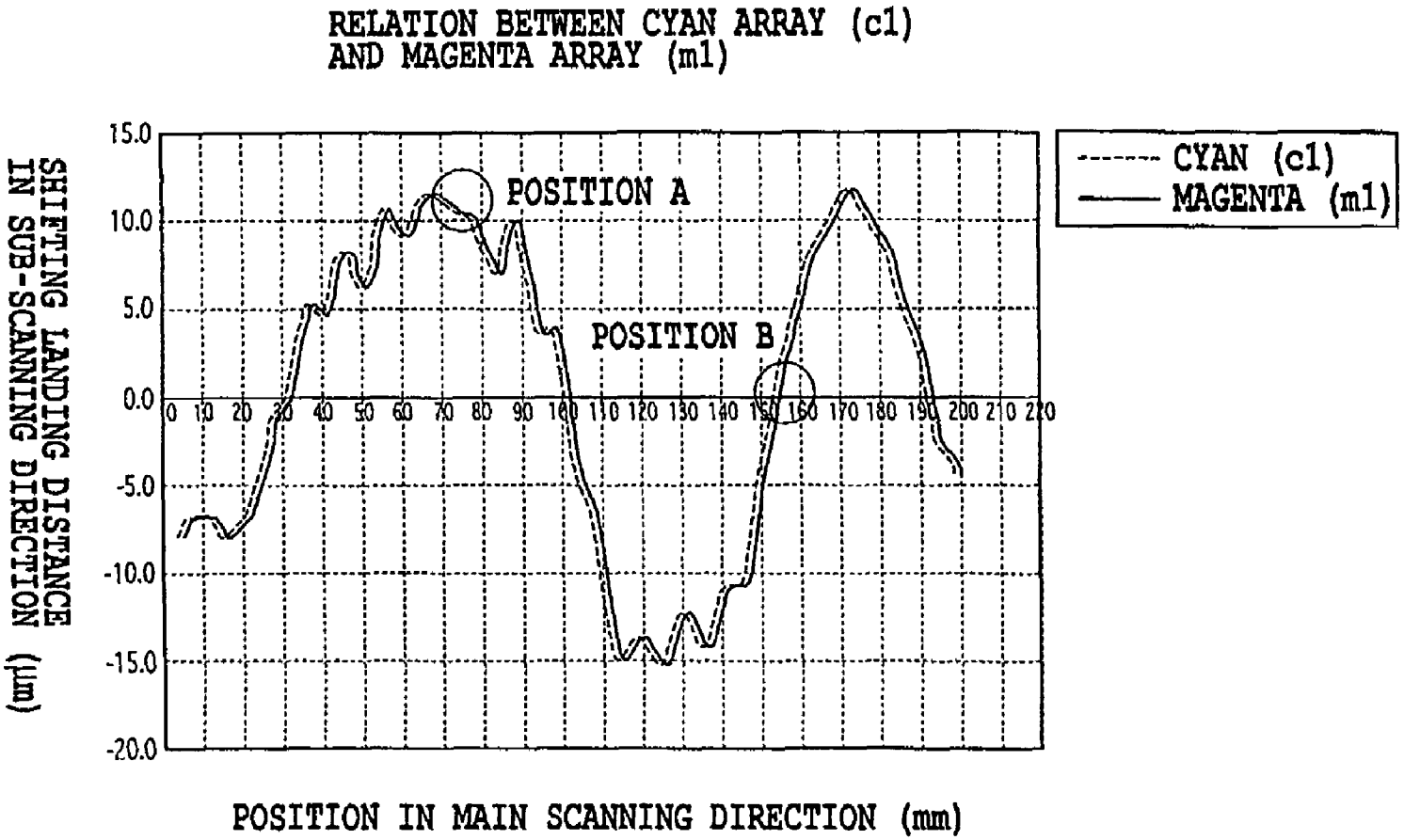
FIGS. 8A to 8C are graphs showing the position shifting distances, for dots printed by nozzle arrays, in the sub-scanning direction relative to the main scanning direction of the printing head.
Figure 8B:
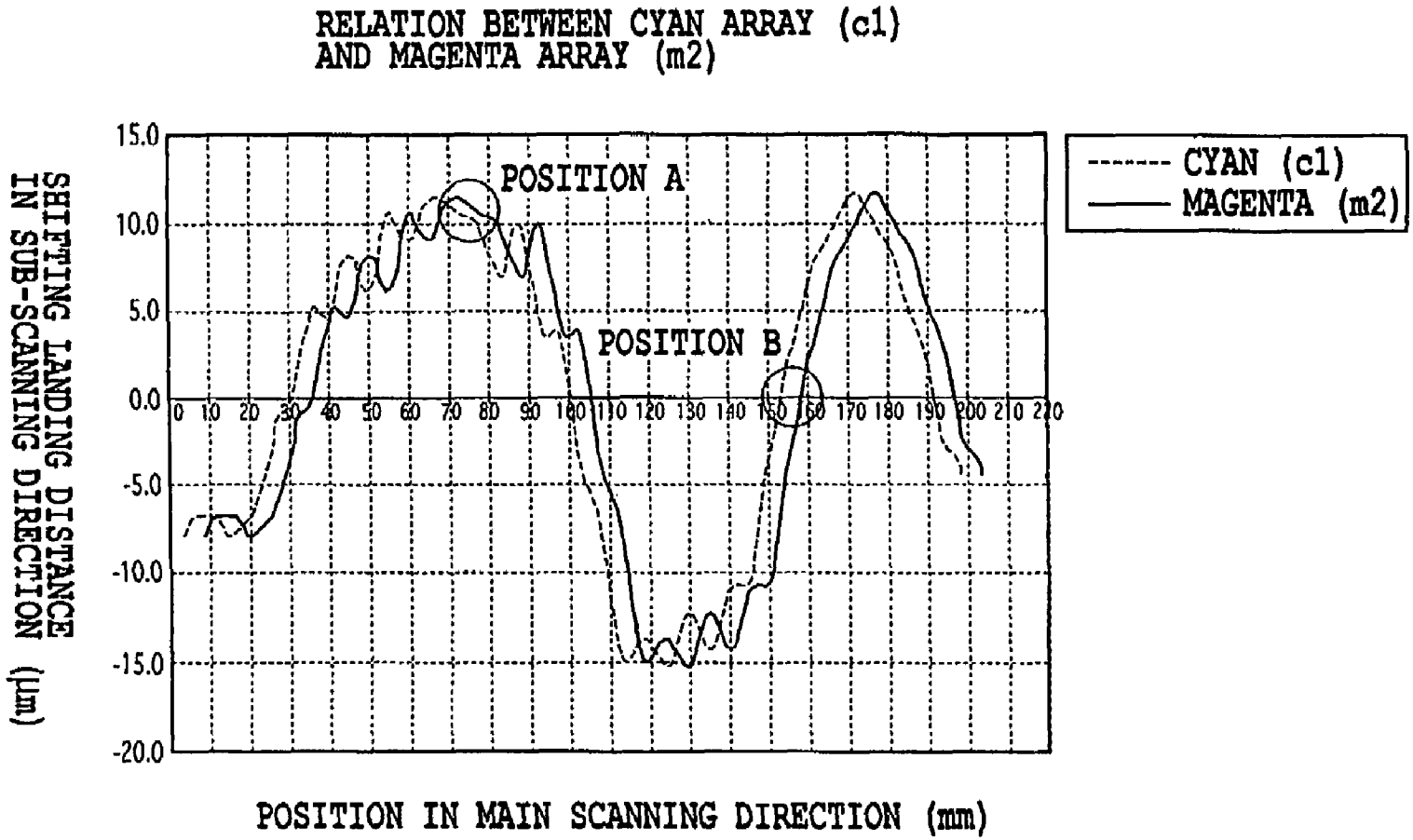
Figure 8C:
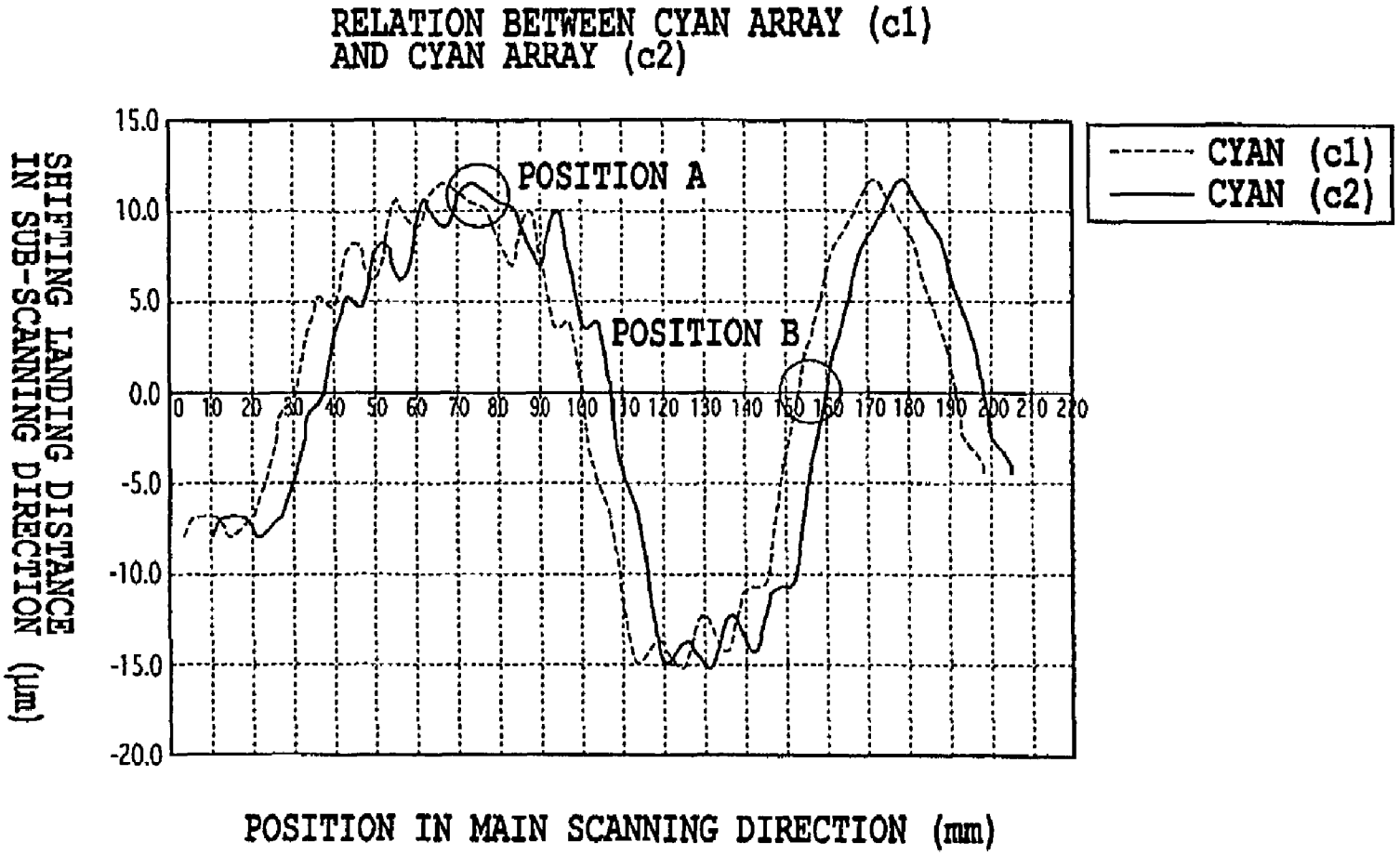

FIGS. 8A to 8C are graphs showing actual measurements of values for the position shift of the individual nozzle arrays, in the sub-scanning direction, as the printing head performs the main scanning. For a general serial printing apparatus, as shown in these graphs, there is a case wherein a printing position shift in the sub-scanning direction is cyclically included in accordance with the movement in the main scanning direction. It is felt that this occurs because of an error in the accuracy at which the printing head is attached, the accuracy of dot landing, or the accuracy at which the carriage of the printing apparatus is moved. However, even when such a cyclic error is included, a critical image forming problem rarely occurs during monotone printing or during color printing, wherein individual colors are shifted equally. However, when, as described above, the printing head wherein the printing element arrays are arranged in parallel in the main scanning direction is inclined, an area wherein a difference of position among the nozzle arrays is large, and an area wherein the difference is small, appears cyclically, depending on the position of the printing head in the main scanning direction.

In FIG. 8A, the shifting of the dot landing positions for the nozzle arrays c1 and the nozzle array m1 are shown. The two nozzle arrays c1 and m1 are located in adjacent grooves on the printing head, and the trend for the shifting distance in the sub-scanning direction substantially matches across the entire main scanning area. In FIG. 8B, the shifting of the nozzle array c1 and the nozzle array m2 are shown, and in FIG. 8C, the shifting of the nozzle array c1 and the nozzle array c2 are shown. As is apparent from these graphs, when the interval between the two nozzle arrays in the main scanning direction is greater, the difference between the shifting of the two arrays becomes noticeable.

An explanation will be further given by focusing on other positions in the main scanning direction, such as a position A (a position of about 70 mm) and a position B (a position of about 155 mm) in the main scanning direction. At the position A, all the pairs of nozzle arrays shown in FIGS. 8A to 8C show only comparatively small differences in the shifting distance, i.e., about 3 μm or less. However, at the position B, a considerably large difference in the shift, i.e., about 8 μm, appears in FIGS. 8B and 8C. A large cause of adverse image effects is the cyclic fluctuation of differences in the shifting distance, depending on the position in the main scanning direction, rather than a large value in the difference in the shifting distance. That is, when a uniform image is formed by nozzle arrays, such as c1 and m1, that are comparatively distant, the rate at which cyan dots and magenta dots overlap, or the rate (a so-called area factor) at which a blank area appears fluctuates, depending on the position of the printing head in the main scanning direction, and this fluctuation is identifiable as an uneven density or an uneven color.

To prevent the fluctuation of the area factor, for example, the INDEX pattern can also be changed.

Figure 9:
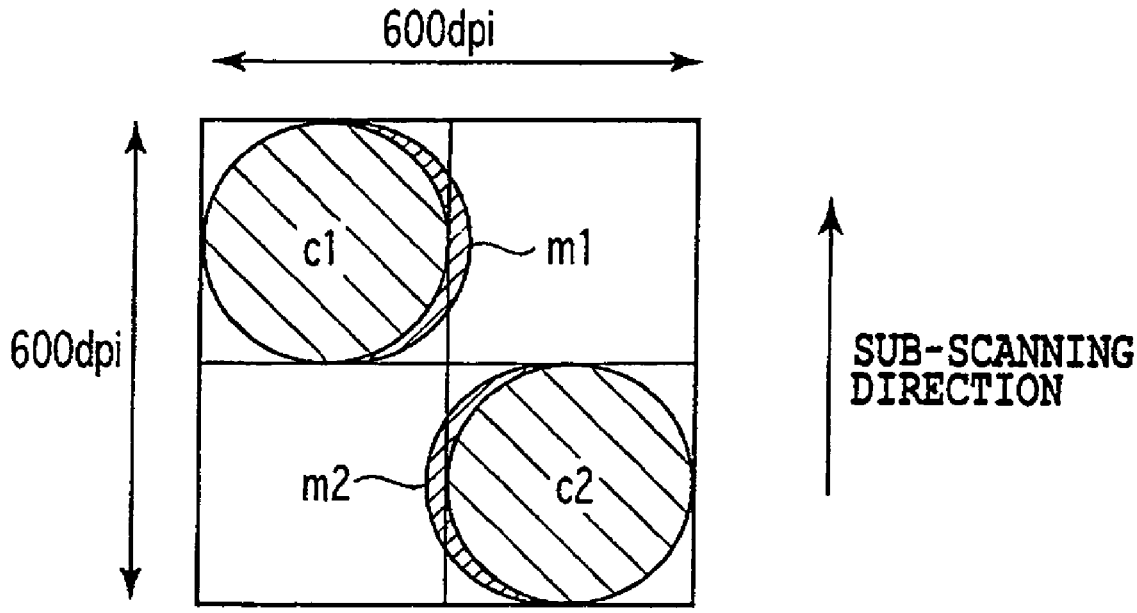
FIG. 9 is a diagram showing an example INDEX pattern devised so that the dot position shifting problem does not appear.

FIG. 9 is a diagram showing an example INDEX pattern wherein the above described position shifting of dots does not appear when using the conventional printing head shown in FIG. 5. In this example, in a 2×2 pattern, two cyan dots and two magenta dots are printed by the nozzle arrays c1 and m1 in the left column, while two cyan dots and two magenta dots are printed by the nozzle arrays c2 and m2 in the right column, so that, dots of different colors to be formed by the same column are printed by nozzle arrays located as near each other as possible. In this case, different color dots to be formed in the same column are printed at the same position by the nozzle arrays (c1 and m1) located comparatively near each other, and different color dots for the nozzle arrays (c2 and m2) located comparatively farther apart are printed at positions at a distance.

In the state in FIG. 7C, dots are shown when an image is formed by a printing head having an inclination of about 1°, using the above described INDEX pattern. Even when the printing head is inclined about 1°, dots to be formed in the same column are printed by adjacent nozzle arrays (c1 and m1, or c2 and m2), and the shift between the two is almost not recognizable. On the other hand, dots located at a distance, i.e., the interval between the printing positions of c1 and m1 and the printing positions of c2 and m2, are affected by the inclination, compared with the normal positions shown in FIG. 9. However, such a shift does not cause a fluctuation in the area factor, and also a change in the density and the hue. Therefore, as shown in the graphs in FIGS. 8A to 8C, when the shifting distance is changed in accordance with the position in the main scanning direction, an uneven color or an uneven density rarely occurs.

However, the CM separation can not be appropriately performed by using the INDEX pattern shown in FIG. 9. The CM separation is a technique especially effective, as in this embodiment, for printing dots using small droplets to form a high-quality image. As previously described, the objective of the present invention is to not only perform the printing of small dots and the CM separation, but also to suppress, to the extent possible, a cyclic unevenness in the main scanning direction that is unique to a serial color ink-jet printing apparatus.

In FIG. 7D, the dot arrangement is shown when the printing head in FIG. 4 for this embodiment is employed. As in FIGS. 7B and 7C, the color chip 1100 of the printing head is arranged while turned to the right about 0.1°. Of course, by using the printing head of this embodiment, shifting in the printing positions of the nozzle arrays appears noticeable since there are large intervals between the nozzle arrays in the main scanning direction. However, in this embodiment, when the INDEX pattern in FIG. 6B for performing the CM separation is employed, the image problem shown in FIG. 7B does not occur. According to the dot arrangement in this embodiment, magenta dots printed by the nozzle away m1 are located below cyan dots printed by the nozzle away c1, and cyan dots printed by the nozzle array c2 are located below magenta dots printed by the nozzle away m2. That is, dots are printed, in the same column, by adjacent nozzle arrays, and no large difference in the shifting distance appears for the printing positions of dots that are arranged in the same column. Furthermore, dots to be formed by nozzle arrays located at a distance are printed in a different column, and even when these dots are shifted in the sub-scanning direction, the affect on the area factor is small.

As a result, as shown in FIG. 7D, when the printing head for this embodiment is employed, unlike in FIG. 7B, the blank portions and the portions where dots are unnecessarily overlapped are not clearly distinguishable, and a dot arrangement state can be provided that is near that of the ideal state in FIG. 7A. Therefore, even under the cases explained referring to FIGS. 8A to 8C, wherein the shifting of the printing position in the sub-scanning direction cyclically fluctuates, if the printing head of this embodiment is employed and the INDEX pattern in FIG. 6B is employed, the uneven density and uneven color seldom occur.

The printing condition for the nozzle arrays c1, c2, m1 and m2, for forming large dots, has been explained. The same effects can be obtained for the nozzle arrays c3, m3, c4 and m4 for forming small dots.

Figure 10:
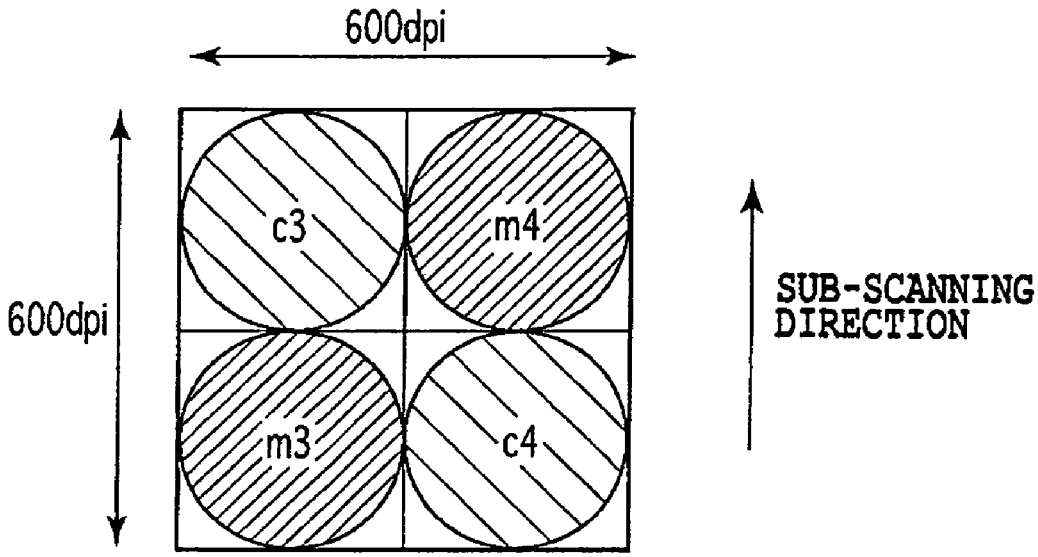
FIG. 10 is a schematic diagram showing the state of an INDEX pattern for small dots.

FIG. 10 is a schematic diagram showing an INDEX pattern for small dots that are ejected by the nozzle arrays c3, m3, c4 and m4. As for large dots, an INDEX pattern by which the CM separation is performed is prepared for small dots, so that, small cyan dots and small magenta dots are not overlapped as possible. When such a dot arrangement is provided by the printing head in FIG. 4 for this embodiment, magenta dots printed by the nozzle array m3 are located immediately below cyan dots printed by the nozzle array c3, and cyan dots printed by the nozzle array c4 are located immediately below magenta dots printed by the nozzle array m4. That is, cyan and magenta dots, continued in the direction in which a printing medium is conveyed, are printed by nozzle arrays that are formed in adjacent grooves.

Specifically, as for forming large dots, in a case wherein the printing position shift in the sub-scanning direction cyclically fluctuates relative to the position in the main scanning direction, so long as the INDEX pattern shown in FIG. 10 is employed, an uneven density or an uneven color, which is caused during printing using the conventional printing head, rarely occurs. Generally, small dots are affected by a mechanical error more easily than are large dots, and an uneven color and an uneven density are also easily noticeable. Thus, the use of the printing head of this embodiment is more effective for small dots.

In this embodiment, an explanation has been given for the configuration of the printing head wherein multiple cyan and magenta nozzle arrays for forming large and small dots are arranged in the main scanning direction. In this printing head, two nozzle arrays that print dots having the same color and the same diameter are symmetrically located in the main scanning direction of the printing head and are shifted in the sub-scanning direction at ½ pitch of the nozzle arrangement. Furthermore, cyan and magenta nozzle arrays that are located at a distance are arranged without being shifted away from each other in the sub-scanning direction. When the CM separation using the INDEX technique is performed using the thus arranged printing head, an image forming problem, such as an uneven density or an uneven color, that is accompanied by the moving of the carriage can, to the extent possible, be prevented, regardless of whether the chip of the printing head is inclined during the manufacturing process, or whether there is a mechanical error involving the printing apparatus.

Another Embodiment

Figure 11:
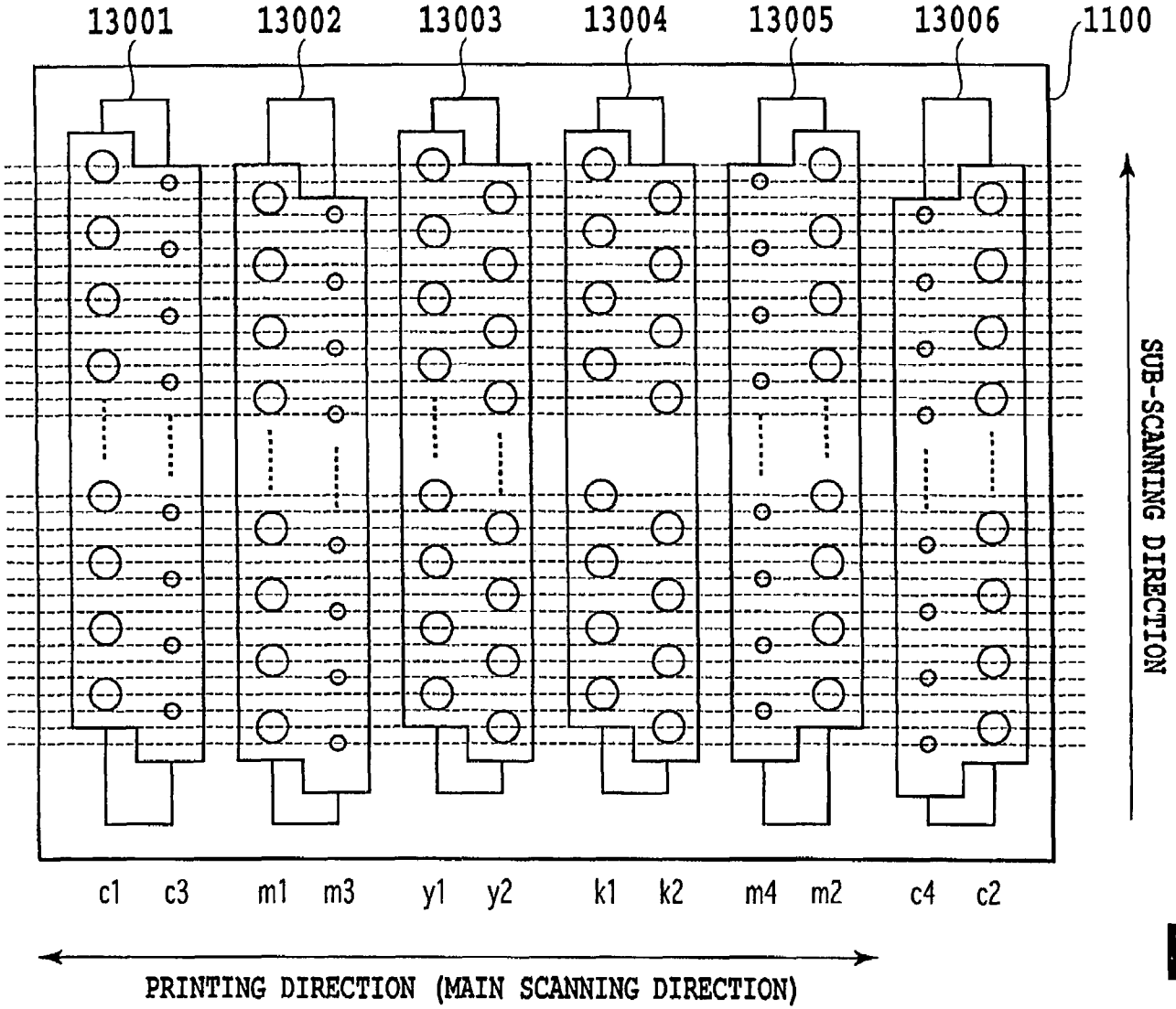
FIG. 11 is a schematic diagram showing the state wherein black dye nozzle arrays are arranged on a color ink chip.

FIG. 11 is a schematic diagram showing the state wherein black dye nozzle arrays k1 and k2 are provided for the color ink chip 1100, in addition to cyan, magenta and yellow ink nozzle arrays. Even for a configuration, like the printing head shown in FIG. 3, wherein a black chip is mounted for the black pigment ink that requires a greater number of nozzles, it is useful to have a nozzle array for black dye ink arranged on a color chip, because a high quality photographic image can be provided. In this embodiment, a groove 13004 for black dye ink is formed between a groove 13003 for yellow ink and a grove 13005 for magenta ink, in addition to the arrangement of the embodiment shown in FIG. 4.

In the arrangement shown in FIG. 11, since the groove 13004 for black ink is formed, the distances between arrays c1 and c2, c3 and c4, m1 and m2 and m3 and m4 are greater than are those in the above embodiment, and an image forming problem can more easily occur. Thus, while a photographic image having a quality higher than that in the embodiment in FIG. 4 can be formed, the arrangement of the printing head of the present invention can be more effectively workable.

For the above described ink jet printing apparatus, cyan, magenta, yellow and black ink have been prepared. In addition, red, blue, green, light cyan and light magenta ink may be employed. As the number of ink colors or the sizes of dot diameters to be used are increased, the number of grooves to be formed in the color chip and the width of the color chip are also increased. That is, since the shifting distance for the printing position, due to inclination, and the image forming problem, due to fluctuation, are also increased, the present invention can more effectively resolve these shortcomings.

Further, the ink jet printing apparatus that includes heaters inside the printing elements has been explained. However, the present invention is not limited to this configuration. Energy for ejecting ink may not be generated by an electrothermal converter, such as a heater, and a color agent may not be a liquid, such as ink. The present invention can be applied for any printing apparatus that employs a printing head that includes a plurality of printing elements and that prints a color image by forming dots on a printing medium.

According to the present invention, since dots of different colors, which are to be formed on the same raster in the sub-scanning direction, are printed by nozzle arrays located nearer each other, a high quality image can be formed that has no uneven density or uneven color, regardless of whether a printing head is inclined and of whether, depending on the position of the printing head in the main scanning direction, a cyclic shift occurs in the printing positions.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-044244 filed Feb. 21, 2005, which is hereby incorporated by reference herein.

What is claimed is:

1. A printing apparatus using a printing head, which comprises:

a plurality of printing element arrays, in each of which a plurality of printing elements discharging a color agent on a printing medium are arranged at a predetermined pitch in a predetermined direction, provided in accordance with color agent types and amounts of color agent to be discharged, wherein the printing head is scanned in a direction differing from the predetermined direction to form an image on the printing medium, wherein the printing head has, for each of at least two types of color agents, first and second printing element arrays for discharging the same color agent in the same amount, the first and second printing element arrays being shifted relative to each other by half the predetermined pitch in the predetermined direction, and third and fourth printing element arrays for discharging the same color agent in the same amount smaller than that of the first and second printing element arrays, the third and fourth printing element arrays being shifted relative to each other by half the predetermined pitch in the predetermined direction, wherein the first and third printing element arrays are adjacent to each other in the scanning direction and shifted by an amount less than half the predetermined pitch in the predetermined direction, wherein the first and second printing element arrays and third and fourth printing element arrays for each of the at least two types of color agents are arranged at positions such that color orders are symmetrical in the scanning direction, respectively, and wherein the first printing element array for one of the at least two types of color agents is arranged so as to be closer to the first printing element array for the other of the at least two types of color agents than the second printing element array for the other type of color agent, and the first printing element array for the one of the at least two types of color agents, and the first printing element array for the other of the at least two types of color agents are arranged so as to be shifted relative to each other by half the predetermined pitch in the predetermined direction.

2. A printing apparatus according to claim 1, wherein the first and second printing element arrays and third and fourth printing element arrays for the at least two types of color agents are symmetrically arranged in the scanning direction, so that the order in which the color agent is discharged to the printing medium is the same regardless of the scanning direction.

3. A printing apparatus according to claim 1, wherein the at least two types of color agents are cyan ink and magenta inks.

4. A printing apparatus according to claim 3, wherein printing is controlled so that, to the extent possible, cyan dots and magenta dots are not overlapped on the printing medium.

5. A printing apparatus according to claim 1, wherein the types of color agent are liquid inks, and the printing elements eject the ink using thermal energy generated by electro-thermal converters which are provided in each printing element.

6. A printing head capable of being mounted on a printing apparatus according to claim 1.

* * * * *

UNITED STATES PATENT AND TRADEMARK OFFICE

CERTIFICATE OF CORRECTION

PATENT NO. : 7,410,239 B2
APPLICATION NO. : 11/350877
DATED : August 12, 2008
INVENTOR(S) : Takahashi et al.

It is certified that error appears in the above-identified patent and that said Letters Patent is hereby corrected as shown below:

COLUMN 3:
Line 38, “affect.” should read --effect.--.

COLUMN 4:
Line 21, “away” should read --array--.

COLUMN 7:
Line 31, “humectants.” should read --a humectant.--.
Line 38, “also” should read --also an--.

COLUMN 8:
Line 10, “ink” should read --inks--.
Line 12, “ink.” should read --inks.--.

COLUMN 12:
Line 35, “away” should read --array--.
Line 41, “affect” should read --effect--.
Line 62, “as” should read --as much as--.

COLUMN 15:
Line 11, “inks.” should read --ink.--.

Signed and Sealed this

Seventeenth Day of March, 2009

John Doll

JOHN DOLL
*Acting Director of the United States Patent and Trademark Office*